US006317922B1

(12) United States Patent
Kondratuk

(10) Patent No.: US 6,317,922 B1
(45) Date of Patent: Nov. 20, 2001

(54) DOOR CLOSER

(75) Inventor: Michael W. Kondratuk, Cameron, WI (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 09/373,947

(22) Filed: Aug. 13, 1999

(51) Int. Cl.[7] ..... E05F 1/08

(52) U.S. Cl. ..... 16/72; 16/82; 16/49; 16/69; 16/58; 16/57; 16/71

(58) Field of Search ..... 16/72, 82, 66, 16/69, 58, 59, 71, 84, 51; 292/DIG. 4

(56) References Cited

U.S. PATENT DOCUMENTS 4,286,412 9/1981 Stevens .
4,382,311 5/1983 Watts .
4,545,322 * 10/1985 Yang ..... 16/85
4,815,163 3/1989 Simmons .
5,630,248 5/1997 Luca .
5,842,255 12/1998 Luca .

* cited by examiner

*Primary Examiner*—Lynne H. Browne
*Assistant Examiner*—Matthew E. Rodgers
(74) *Attorney, Agent, or Firm*—Merchant & Gould PC

(57) ABSTRACT

A door closer includes a cylinder and a piston sliding along the cylinder with a piston rod extending from the cylinder, with the closer mounting at one end to the door and at a second end to the door frame. The door closer has a speed adjustment know extending from a first end for varying the closure rate. Adjustable mounting brackets provide for flexibility in mounting configurations and closing force. A door lock maintains the piston in an extended position and keeps the door open. The lock includes a washer sliding on the piston rod in a first position and locking the rod at a second position. The washer has a tab that engages an angled surface in the first position to prevent locking engagement with the piston rod. A rotatable end cap rotates the washer between the locked position and the unlocked position.

19 Claims, 9 Drawing Sheets

DOOR CLOSER

BACKGROUND OF THE INVENTION

1. Field of the Invention

This invention relates to a door closer, and more particularly to a door closer with advanced manual locking to hold a door open.

2. Prior Art

A door closer is an apparatus to return an opened door to a closed position. Common door closers typically utilize a pneumatic or hydraulic cylinder with an end attachable to a door or door frame. The cylinder contains a piston with a rod extending from the free end of the cylinder. A compression coil spring is enclosed in the cylinder and pushes on the piston which transmits the force to the rod's extending end which is attachable to a door or door frame. The spring urges the piston to return to a maximum retracted position in the cylinder. With typical prior art devices, the speed at which the door closer returns the opened door to its closed position is adjusted by a bolt or screw attached to an end of the cylinder.

Usually a manually operated lock such as a cantable washer is mounted on the portion of the rod extending beyond the cylinder, to allow a user to arrest the door temporarily in an open position. Such a lock is cumbersome to the user and often results in the user pinching their fingers in between the washer and the cylinder. Its operation normally requires two hands, one being used to open and hold the door while the other is used to slide the washer on the rod until it contacts a stop provided on the cylinder. Upon release of the door, the stop cants the washer so that it grasps and arrests the rod and the door is held open. To unlock the door, the user must open the door further to relieve the force on the washer applied by the stop and then slide the washer along the rod to a location where it will not contact the stop for the entire retracting movement of the rod into the cylinder as the door closes.

Door closers with more conventional locks have been proposed in the prior art, but have not gained commercial acceptance. These devices incorporate automatic and semi-automatic locking techniques and are considerably more expensive and intricate than closers with manual locking as described and each have particular drawbacks peculiar to the mechanisms employed. These devices also fail to indicate to the user whether the mechanism is in a locking or unlocking mode, and if an uninformed user were to actuate the device, the door might close on the user unintentionally. Moreover, adjustment of existing door closers are cumbersome. These devices incorporate low profile adjustable screws which are obstructed from accesses by mounting brackets used to attach the cylinder to the door.

It can be seen then that a door closer is needed which is inexpensive, reliable, durable and more convenient to lock and unlock than existing door closers with conventional manually operated locks. The present invention address these problems, as well as others, associated with door closers.

SUMMARY OF THE INVENTION

The present invention is directed to a door closer that employs a cylinder having a free end and an end attachable to a door or door frame, such as may be used with storm doors. Slidably retained within the cylinder is a piston biased by a spring to a maximum retracted position in the cylinder. The piston is attached to a first end of a rod having a second end that extends from the cylinder and is attachable to a door frame or door. Confined to a location proximal the free end of the cylinder and riding on the rod, is a cantable washer. Structural members at the proximal end of the cylinder maintain the washer in a perpendicular orientation on the rod so that the rod may slide through the washer freely as the door is opened or closed when the structural elements are rotated to a first position. To initiate locking, the structural elements are rotated to a second position which causes the washer to cant, arrest the piston rod, and hold the door open. Thus, unlike conventional door closers employing a cantable washer, the user does not have to slide the washer on the rod to a desired latching position or continuously engage an automatic or semi-automatic locking mechanism. In the present invention, the washer is intrinsically canted to contact the rod by the door closer itself when locking is activated.

In a more particular example of the invention, the door closer has an end cap coupled to the cylinder proximate the free of the cylinder and rotatable between a first and second position. A support cap member having angled surfaces is coupled to the cylinder and longitudinally spaced from the end cap and intermediate the end cap and the spring. An L-shaped washer is mounted on the rod within the cylinder between the end cap and the support cap member. The end cap and support cap members both have passages formed through them for receiving the piston rod. The end cap further includes an inner cavity and first and second retainer tabs coupled to the end cap within the inner cavity and extending parallel to the piston rod. The first retainer tab is positioned parallel and apart from the second retainer tab such that the angled washer is assembled within the end cap, disposed and held between the first and second retainer tabs. The L-shaped washer is retained between the first and second retainer tabs and maintained by the angled contact surfaces of the support cap in a position which is substantially perpendicular to the piston rod, allowing the rod to freely retract and extend within the cylinder when locking is not desired and the end cap is rotated to the first, unlocked position. When locking is desired, the end cap is rotated to the second, locked position whereat the extended leg of the retained washer engages the contact surface perpendicular to the piston rod and the washer is maintained in a position where the washer eccentrically contracts and arrests the piston from further retraction into the cylinder. Once the end cap is rotated to its locking position, the door can be opened further and again held to a new opening position. The door will only close when the end cap is rotated to its unlocked position.

A knob-type adjusting screw is coupled to the attachable end of the cylinder. A bracket, which attaches the cylinder to the door or door frame, is arranged to provide non-intrusive access to the adjusting screw. A jamb bracket, which couples the attachable end of the piston rod to the door or door frame, accommodates two piston rod connection holes, allowing adjustment of the piston rod retraction within the cylinder and enabling the piston to trigger an air release valve within the cylinder to provide the door closer with an additional "kick" as the piston arrests to its retracted position. In addition, a cover bracket can be added to the jamb bracket to provide aesthetic appeal.

The present invention provides a door closer which is more user friendly and safe to operate. The closer provides easy reliable adjustment and actuation for closing and locking that is not possible with prior art closer devices.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring to the drawings, wherein like reference letters and numerals indicate corresponding structure throughout the several views.

DETAILED DESCRIPTION

Figure 1:
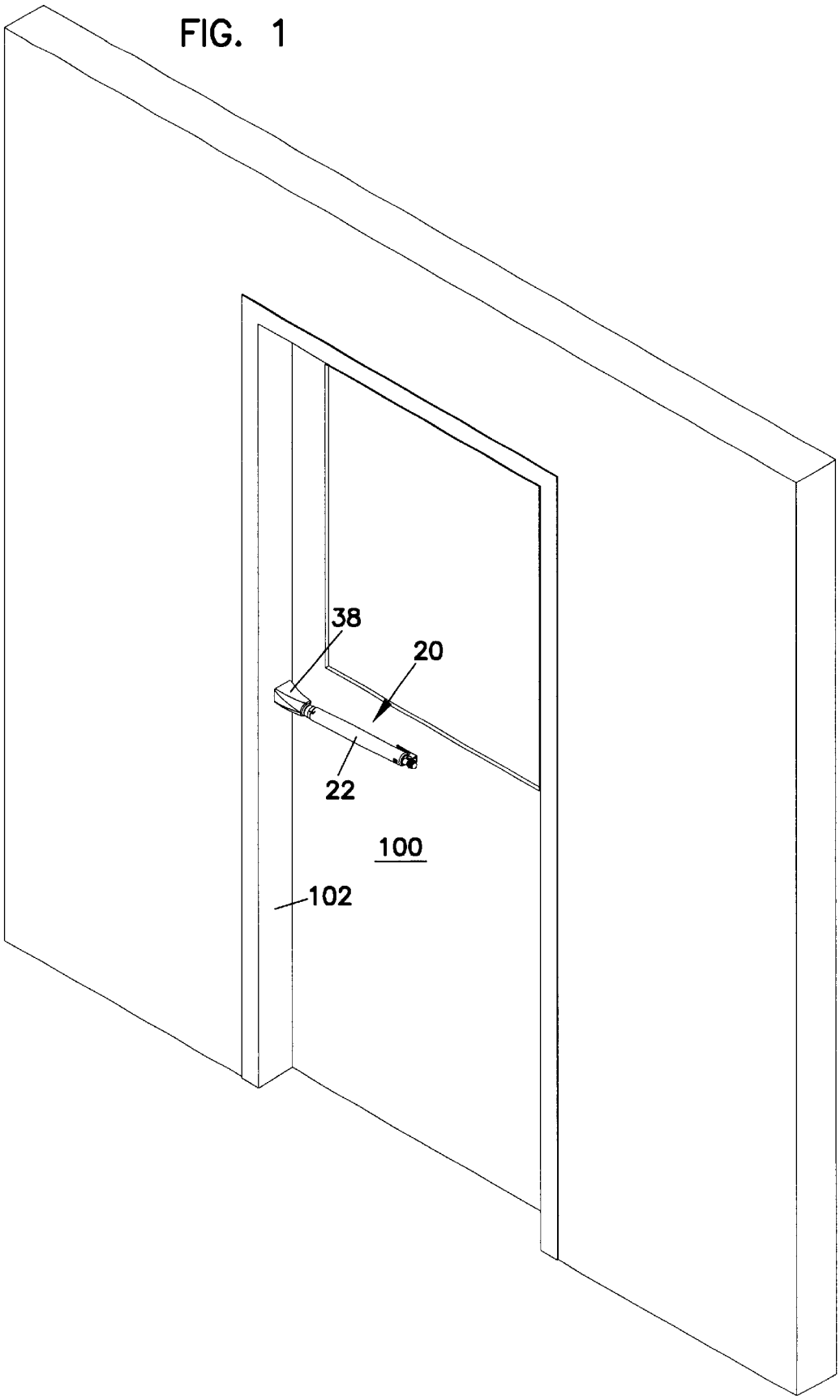
FIG. 1 shows a perspective view of a door and door closer according to the principles of the present invention, with the door at a closed position.
Figure 2:
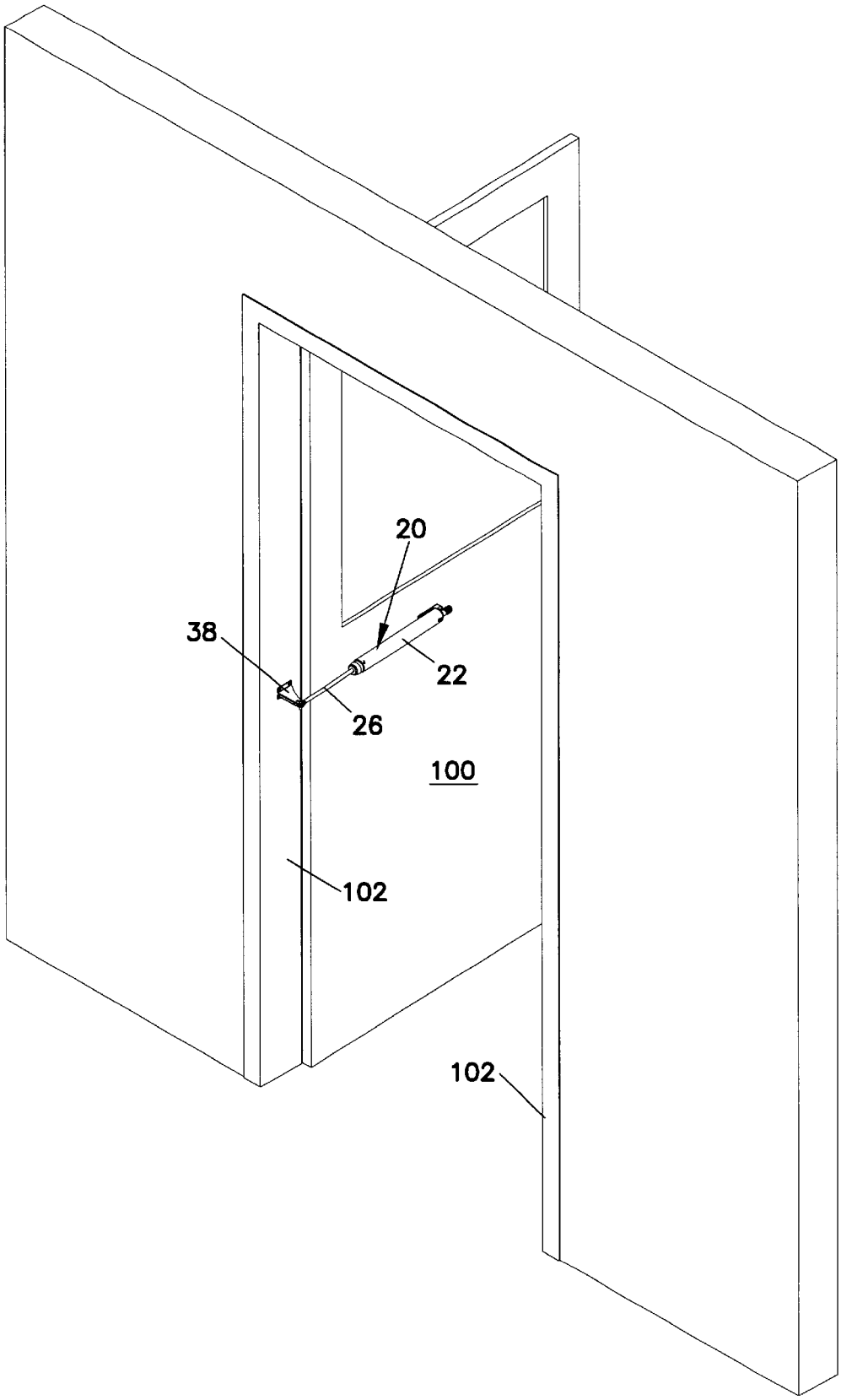
FIG. 2 shows a perspective view of the door and the door closer of FIG. 1 with the door held at an open position.
Figure 3:
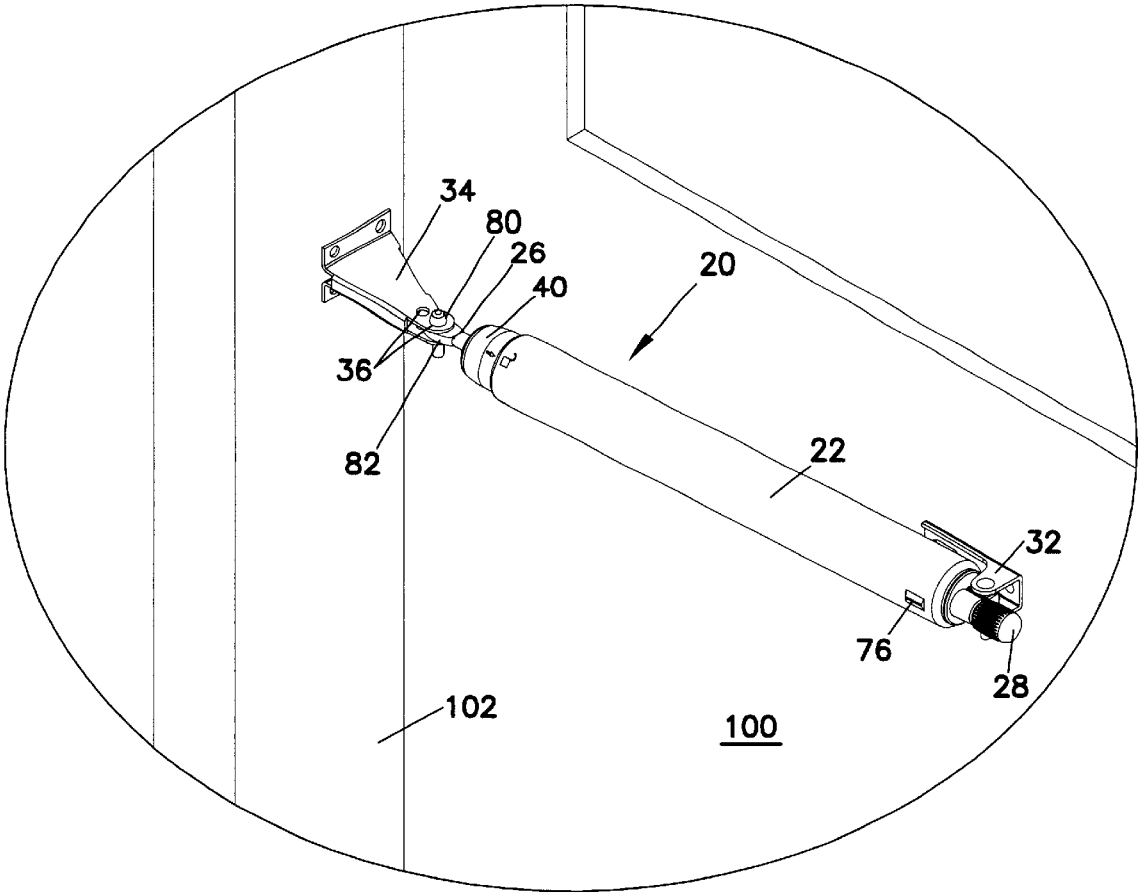
FIG. 3 shows a perspective view of the door closer and the mounting to the door and frame.

Referring now to the drawings, and in particular to FIGS. 1 and 2, there is shown a door closer, generally designated 20, for a door 100. The door closer 20 is typically a pneumatic or hydraulic closer that is spring actuated, as explained hereinafter, and holds the door 100 in the open position shown in FIG. 2, or pulls the door 100 to the closed position shown in FIG. 1. The closer 20 mounts at one end to the door 100 and connects on the other end to the frame 102. As shown in FIG. 3, first and second mounting brackets 32 and 34 provide for mounting to the door 100 and door frame 102. The brackets 32 and 34 provide for mounting flexibility as they can be positioned to provide for various mounting configurations that may be required with various style doors. The first mounting bracket 32 typically mounts to the door and is connected by a pin to the door closer 20. The bracket 32 may be reversibly mounted depending upon the mounting needs. The second mounting bracket 34 typically mounts to the door frame 102. The door closer 20 mounts to the mounting bracket 34 with a pin 80 inserting into one of two mounting holes 36.

The door closer 20 may have the closing force adjusted by moving to one or the other of the mounting holes 36 in the first mounting bracket 32. For example, some doors may have screens or glass panes that may be interchanged, depending on the season. With the glass panes removed, less force may be required and the closer may be adjusted accordingly.

Closing speed may be adjusted by rotating an adjustment knob 28 to adjust the release of pressure, as is well know. The adjustment knob 28 is easily accessed unlike prior screw-type speed adjustment mechanisms which were difficult to access. Access is also made easier by configuring the second mounting bracket 34 to extend toward the closer 20, rather than outward next to and beyond the knob 28. Prior closers typically positioned force adjustment holes on the bracket mounting to the door, so a turning knob would be difficult to access and actuate. Referring again to FIGS. 1 and 2, to provide an aesthetically pleasing mounting configuration, a bracket cover 38 may be attached over the mounting bracket 34. The cover 38 also encloses the pin and piston rod, to decrease the possibility of articles catching on the closer 20.

Figure 4:
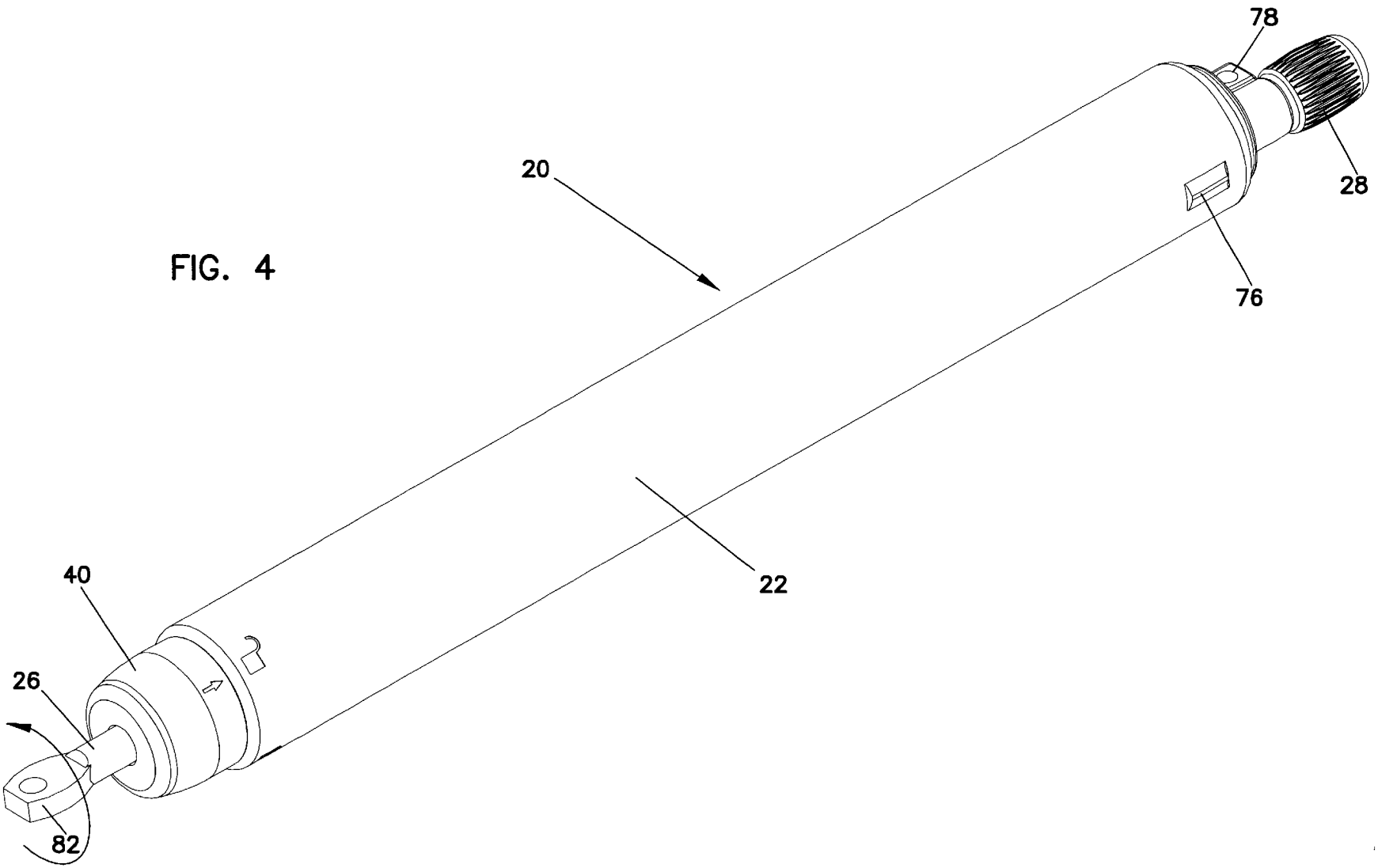
FIG. 4 shows a perspective view of the door closer shown in FIG. 3.

Referring now to FIG. 4, the closer 20 includes a cylinder 22 and a piston (not shown in FIG. 4) with a piston rod 26 mounted thereto and extending from an end of the cylinder 22. The piston rod 26 includes a mounting portion 82 which receives the pin 80 shown in FIG. 3. A vent 76 provides for the instantaneous release of air from the pneumatic cylinder 22 when the piston passes the vent 76. The closure rate may be adjusted by rotation of the adjustment knob 28. A mounting portion 78 provides for attachment to the bracket 32 shown in FIG. 3. An end cap 40 rotatably mounts to the end of the cylinder 22 and has an orifice through which the piston rod 26 extends. The end cap 40 may include an indicator aligning with corresponding words or symbols on the cylinder 22 to indicate whether the door closer is locked or unlocked.

Figure 10:
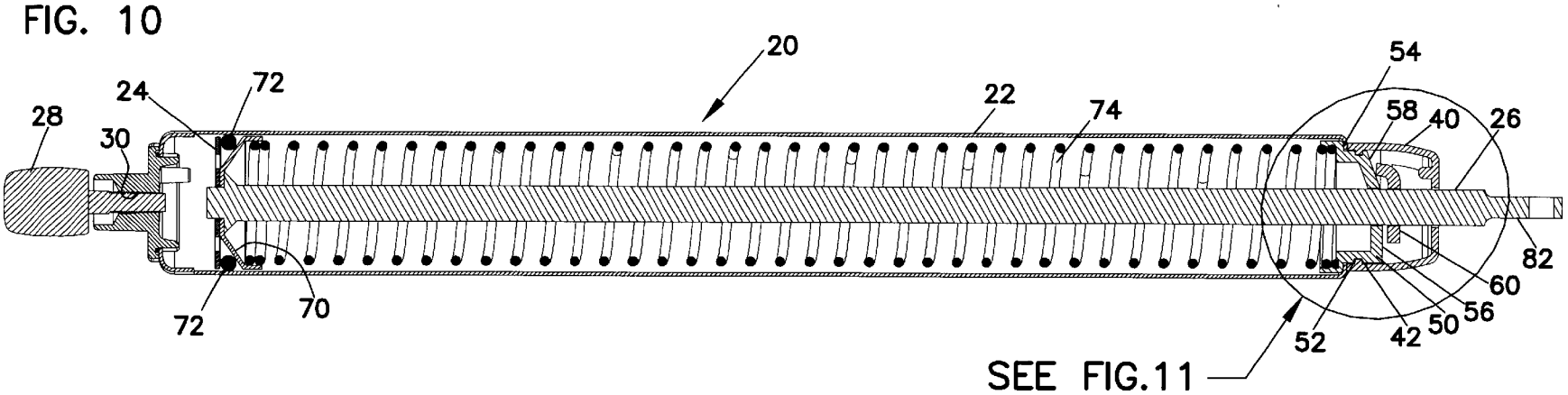
FIG. 10 shows a side sectional view of the door closer shown in FIG. 3 in an unlocked position.

The door closer 20 pulls the door 100 under the force of a spring 74, shown in FIG. 10, at a rate controlled by the damping effect from air releasing around the adjustment knob 28. The closer 20 has sufficient force to close the door 100 against light winds, yet does not slam the door shut. There may be situations in which it is desirable to have the door 100 held open relative to the frame 102, as shown in FIG. 2. To avoid wedges or propping the door open, it is known to use closers which have a stop arrangement. The present invention includes a locking device 48 as shown in FIGS. 5–8 which is enclosed within the cylinder 22 and end cap 40, as shown most clearly in FIG. 4.

Figure 6:
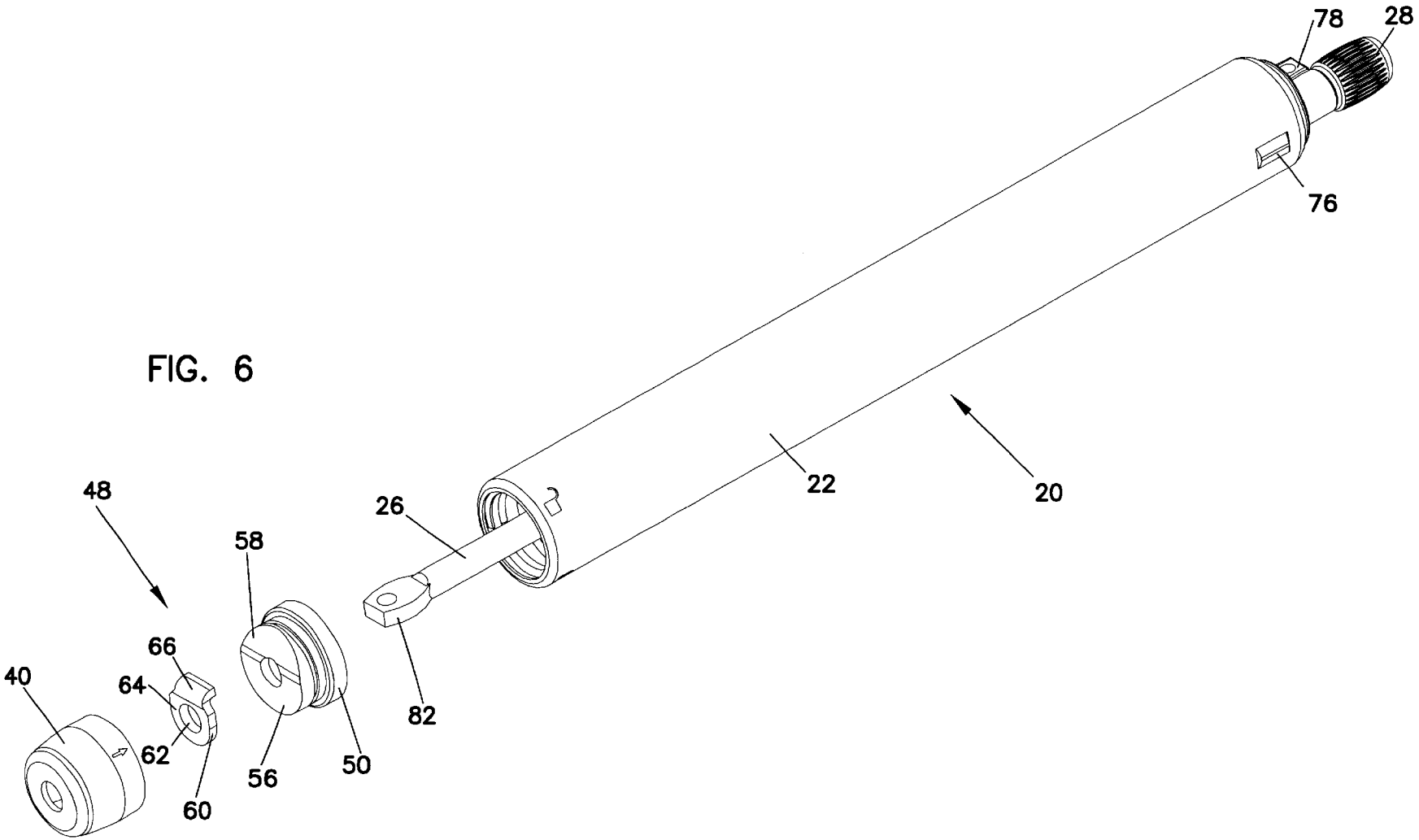
FIG. 6 shows an exploded perspective view from a second end of the door closer shown in FIG. 3.

Referring to FIG. 6, when actuated, the lock device 48 holds the piston rod 26 at an extended position relative to the cylinder 22, to hold the door at an open position, as shown in FIG. 2. Referring again to FIG. 6, the lock device 48 includes an inner cap 50 having a center orifice, through which the piston rod 26 extends. The inner cap 50 has a first surface 56 substantially perpendicular to the axial direction of the cylinder 22 and the piston rod 26. A second surface 58 extends at an oblique angle relative to the first surface 56. The surfaces 56 and 58 provide for engaging a washer 60 at a locked or unlocked position. The washer 60 includes an orifice 62 through which the piston rod 26 extends. In the unlocked position, the washer 60 slides freely along the shaft of the piston rod 26. In the locked position, the washer 60 is displaced from a substantially perpendicular alignment to the piston rod 26, and the edges of the orifice engage and hold the piston rod 26 relative to the cylinder 22. The washer 60 includes a substantially L-shaped profile with a first portion 64 and a substantially perpendicular second portion 66 extending axially toward the inner cap 50. The end cap 40 inserts over the lock device 48 and rotatably mounts to the inner cap 50 as shown in FIG. 10. The end cap 40 includes flanges 42 protruding inward to engage an annular channel 52 formed in the inner cap 50. The end cap 40 has a snap-in type assembly to mount to the inner cap 50. The flanges 42 ride in the channel 52 to provide relative rotation between the end cap 40 and the inner cap 50.

Figure 5:
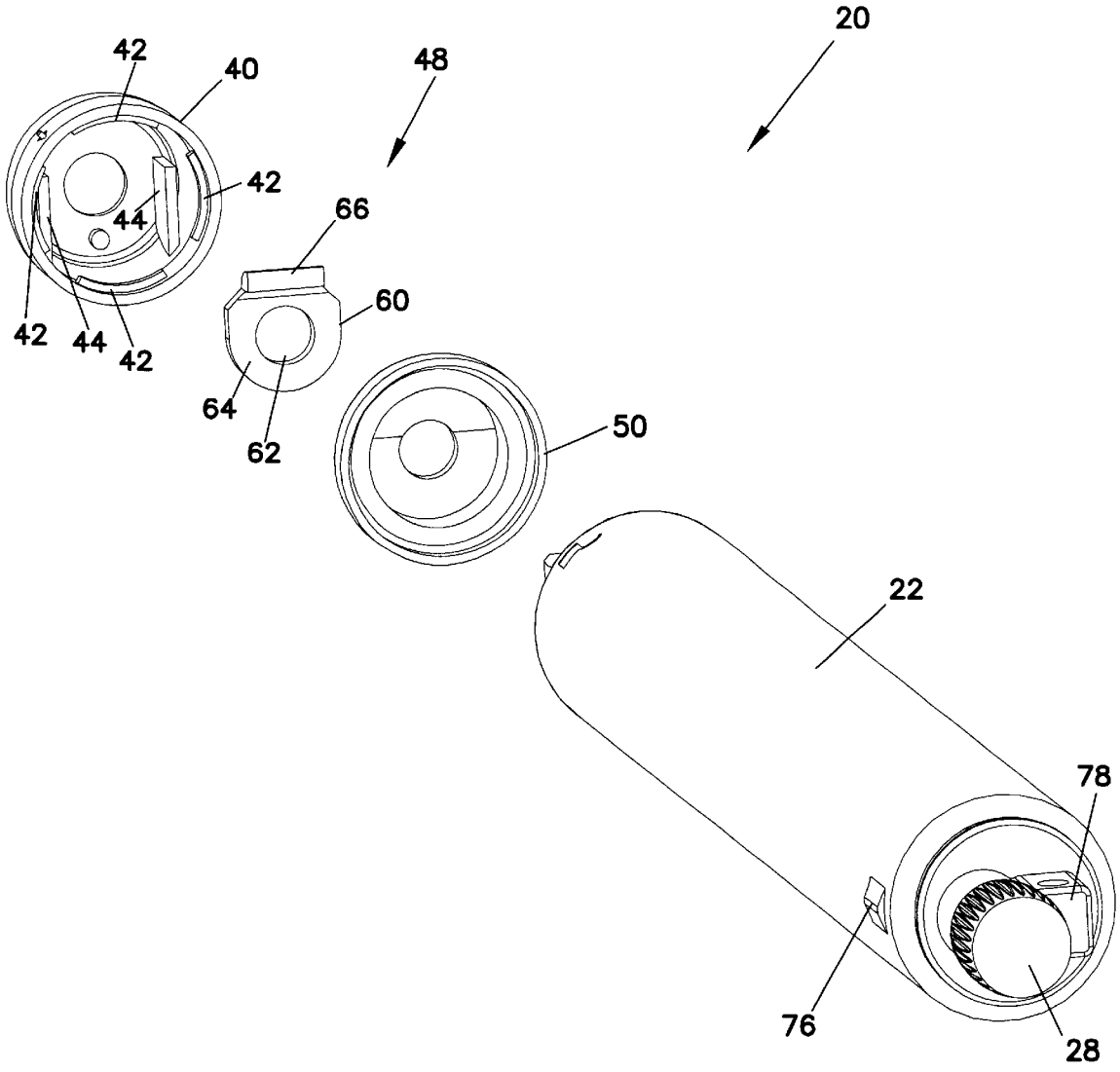
FIG. 5 shows an exploded perspective view from a first end of the door closer shown in FIG. 3.

As explained hereinafter, the washer 60 is rotated between a locked position wherein the piston rod 26 is held stationary relative to the cylinder 22 and an unlocked position wherein the piston rod freely extends and retracts relative to the cylinder 22. Referring now to FIG. 5, rotation is accomplished by the end cap 40 engaging the washer 60. A pair of spaced apart tabs 44 extending axially inward from the end cap 40 engage opposite edges of the first portion 64 of the washer 60. Therefore, when end cap 40 is rotated, the washer 60 rotates with the end cap 40.

Figure 11:
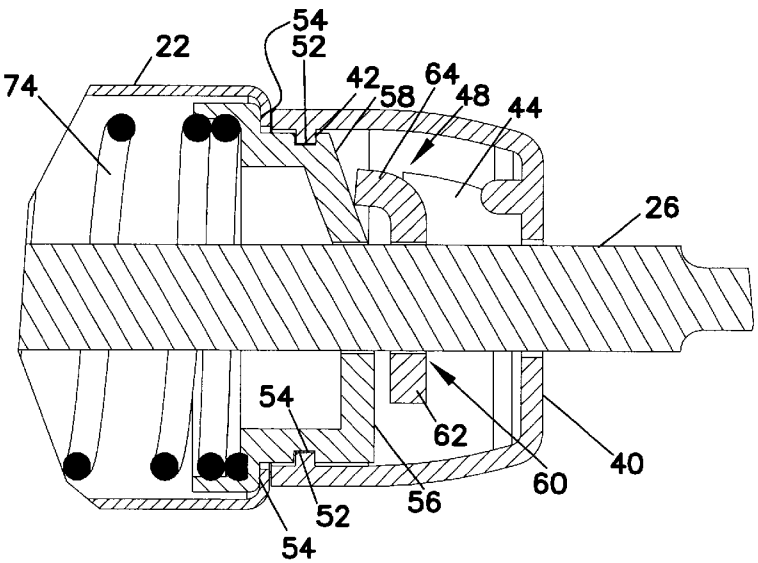
FIG. 11 shows a sectional detail view of the lock mechanism for the door closer shown in FIG. 3.

Referring now to FIG. 10, the closer 20 is actuated by the spring 74 pushing against the piston 24. An o-ring type gasket 72 is retained by a rod mounting portion 70 to force air from the cylinder 22 through the vent 76. Closure speed may be adjusted by twisting the adjustment knob 28 threadably mounted into end portion 30 to act as a valve and control the air release rate. Air resists the force of the spring after it has been compressed to slow the closure rate so that the door 100 does not slam shut. As shown in FIG. 11, the spring 74 engages the inner cap 50 at the second end of the cylinder 22 inward extending end of the cylinder 22 engaging a shoulder 54.

OPERATION

Figure 7:
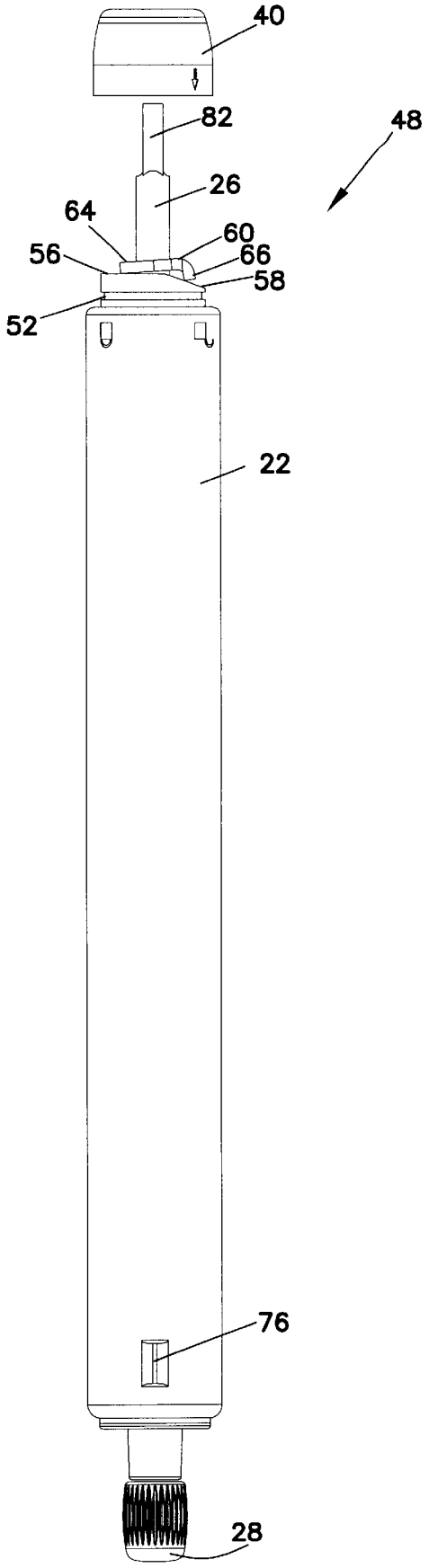
FIG. 7 shows a side elevational view of the door closer shown in FIG. 3 with the end cap removed in an unlocked position.

The closer 20 normally is unlocked and provides a closing force against the door 100. Referring now to FIGS. 7, 10 and 11, when configured for normal operation, the washer 60 is positioned as shown relative to the inner cap 50. When oriented, as shown in FIGS. 7, 10 and 11, the indicator on the end cap 40 is aligned with the unlocked symbol on the cylinder 22. The washer 60 is positioned so that the second portion 66 extending axially toward the inner cap 50 engages the angled surface 58. At this position, the washer 60 cannot be canted or angled relative to the piston rod 26 as the first portion 66 rests substantially flush against the perpendicular surface 56, and cannot be canted. The inner edges of the orifice 62 are parallel to the piston rod 26 and cannot engage and lock the piston rod 26. Therefore, the piston rod can slide freely back and forth within the orifice 62.

Figure 8:
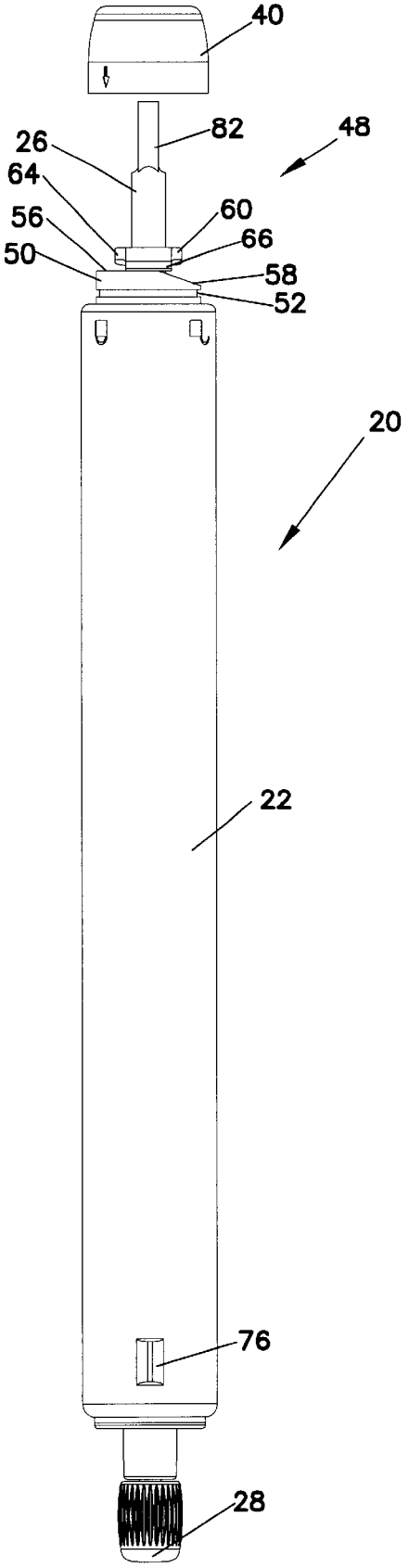
FIG. 8 shows a side elevational view of the door closer shown in FIG. 3 with the end cap removed in a locked position.
Figure 9:
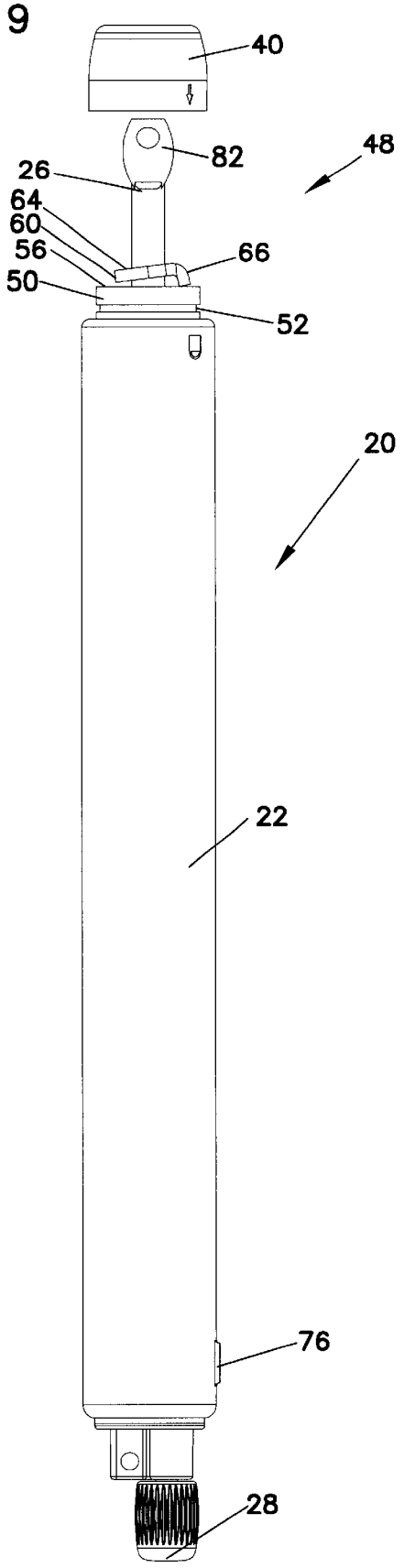
FIG. 9 shows a side elevational view of the door closer shown in FIG. 8 from an angle perpendicular to the viewing angle of FIG. 8.

To hold the door 100 open, the lock device 48 is actuated by rotating the end cap 40. Referring now to FIGS. 8 and 9, when the end cap is rotated so that the arrow 40 is aligned with the locked symbol on the cylinder 22. The washer 60 is rotated with the end cap 40 to the locked position. At the locked position, the axially extending tab portion 66 does not engage the angled surface 60. Therefore, the piston rod 26 engages the edges of the orifice 62 and the first portion 64 is placed at an angle relative to the piston rod 26. The inner edges of the orifice 62 engage and lock the piston rod 26 thereby holding the closer 20 at the desired position. The second portion 66 engages the perpendicular surface 56 and allows the washer to be pushed to an angle locking engagement with the piston rod 26. At the locked position, the piston rod 26 may slide in the washer orifice 62 to a more extended position, but the piston rod 26 may not be retracted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A door closer for a door pivotally mounted to a door frame, the door closer comprising:

a cylinder having a free end and comprising a cylinder housing and an inner end cap, an attachable end adapted for attaching to one of the door or door frame, and a rotatable end cap coupled to the free end of the cylinder and having a passage extending through the rotatable end cap, the rotatable end cap rotating about the axis of the cylinder from a first position to a second position;

a piston slidably mounted within the cylinder and having a piston rod mounted on the piston and extending through the passage in the rotatable end cap, wherein the piston rod is adapted for mounting to the other of the door or door frame;

a biasing element within the cylinder urging the piston toward a retracted position; and a lock mechanism enclosed within the rotatable end cap exterior of the cylinder housing and inner end cap for arresting the piston relative to the cylinder.

2. A door closer as in claim 1, wherein the biasing element is a compression spring and is displaced intermediate the free end of the cylinder and the piston and pushing against the piston.

3. A door closer as in claim 1, wherein the lock mechanism comprises a support member including a cylindrical cap having first and second contact surfaces, wherein the second contact surface is at an oblique angle to the first contact surface, and a passage for the piston rod, and wherein the support member is coupled to the cylinder intermediate the end cap and the biasing element.

4. A door closer as in claim 3, wherein the lock mechanism further comprises a cantable washer mounted on the piston rod within the cylinder intermediate the end cap and the support member, the angled washer being positioned juxtaposed the contact surfaces of the support member.

5. A door closer as in claim 4, wherein the end cap comprises an inner cavity and first and second retainer tabs coupled to the end cap within the inner cavity, the first retainer tab positioned parallel and apart from the second retainer tab such that the angled washer is disposed between the first and second retainer tabs.

6. A door closer as in claim 5, wherein the angled washer is retained between the first and second retainer tabs and maintained by the angled contact surface in a position which is substantially perpendicular to the piston rod, thereby allowing the piston rod to freely retract and extend within the cylinder when locking is not desired and the end cap is rotated to the first, unlocked position.

7. A door closer as in claim 6, wherein the angled washer is retained between the first and second retainer tab and maintained by the contact surfaces in a position where the washer eccentrically contracts and arrests the piston rod from further retraction into the cylinder when locking is desired and the end cap is rotated to the second, locked position.

8. A door closer as in claim 3, wherein the end cap includes an annular flange about its base and is coupled to the support member by a first snap-ring about the annular flange.

9. A lock mechanism used for a door closer having a cylinder retaining a slidable piston attached to a piston rod, the mechanism comprising:

a cap element coupled to the cylinder, the cap element comprising a first contact surface substantially perpendicular to the piston rod, a second contact surface adjacent to and at an oblique angle relative to the first contact surface, and a passage for the piston rod; and an L-shaped washer having a first leg having an orifice formed therethrough adapted for receiving the piston rod, and a second leg extending substantially transversely from the first leg toward the cap element, wherein the washer and the cap element are rotatable relative to one another between a first and second position, wherein the second leg engages the second contact surface and maintains the first leg of the washer in a position substantially perpendicular to the piston rod, allowing the piston rod to freely retract and extend within the cylinder when latching is not desired and the washer is rotated to a first, unlocked position.

10. A locking mechanism as in claim 9, wherein an actuator located within the cylinder retains and rotates the washer about the axis of the cylinder between a first and second position.

11. A locking mechanism as in claim 9, wherein the second leg engages the first contact surface and maintains the first leg of the washer in a position canted to the first contact surface where the washer eccentrically contacts and arrests the piston rod from movement relative to the cylinder when locking is desired and the washer is rotated to a second, locked position.

12. A door closer for a door pivotally mounted to a door frame, the door closer comprising:

a cylinder having a cylinder housing with a free end, an attachable end adapted for attaching to one of the door or door frame, and a rotatable end cap coupled to the free end of the cylinder housing and having a passage extending through the end cap;

a piston slidably mounted within the cylinder having a piston rod mounted on the piston and extending through the passage in the end cap, wherein the piston rod is adapted for mounting to the other of the door or door frame;

a biasing element within the cylinder housing urging the piston toward a retracted position;

a support member coupled to the cylinder housing and spaced apart from the end cap intermediate the end cap and the piston biasing element, the support member comprising a cylindrical cap having a first face extending toward the end cap and including an angled contact surface; and a cantable washer mounted on the piston rod exteriorly of the cylinder housing intermediate the cap and the support member, wherein the washer is juxtaposed the first face of the support member.

13. A door closer as in claim 12, wherein the end cap comprises an inner cavity and first and second retainer tabs coupled to the end cap within the inner cavity, the first retainer tab positioned parallel and apart from the second retainer tab such that the washer is disposed between the first and second retainer tabs.

14. A door closer as in claim 13, wherein the washer comprises a planar portion and a leg extending out of the plane of the planar portion, wherein the washer is retained between the first and second retainer tabs and maintained by the leg engaging the angled contact surface in a position wherein the planar portion is substantially perpendicular to the piston rod, thereby allowing the piston rod to freely retract and extend within the cylinder when locking is not desired and the end cap is rotated to a first, unlocked position.

15. A door closer as in claim 14, wherein the angled washer is retained between the first and second retainer tabs and disengaged from the angled contact surface in a position whereat the washer eccentrically contracts and arrests the piston rod from further retraction into the cyclinder when locking is and the end cap is rotated to a second, locked position.

16. A door closer as in claim 12, wherein the door closer comprises a pneumatic door closer.

17. A door closer as in claim 9, wherein the cylinder comprises a cylinder housing and an inner end cap, and wherein the lock mechanism is exterior of the cylinder housing and inner end cap.

18. A door closer for a door pivotally mounted to a door frame, the door closer comprising:

a cylinder having a free end, an attachable end adapted for attaching to one of the door or door frame, and a rotatable end cap coupled to the free end of the cylinder and having a passage extending through the end cap, the end cap rotating about the axis of the cylinder from a first position to a second position;

a piston slidably mounted within the cylinder and having a piston rod mounted on the piston and extending through the passage in the end cap, wherein the piston rod is adapted for mounting to the other of the door or door frame;

a biasing element within the cylinder urging the piston toward a retracted position; and a lock mechanism enclosed within the end cap for arresting the piston relative to the cylinder, comprising a support member coupled to the cylinder and spaced apart from the end cap intermediate the end cap and the piston biasing element, the support member having a first face extending toward the end cap and including an angled contact surface at an oblique angle to the first face; and a washer that engages the angled contact surface in a first position, which holds the washer to allow the piston rod to freely retract and extend within the cylinder when locking is not desired and the end cap is rotated to a first, unlocked position.

19. A door closer as in claim 18, wherein the washer engages only the first face in a position wherein the washer eccentrically engages and arrests the piston rod from further retraction into the cylinder when locking is desired and the end cap is rotated to a second, locked position.

* * * * *